US006828732B2

(12) United States Patent
Yang et al.

(10) Patent No.: US 6,828,732 B2
(45) Date of Patent: Dec. 7, 2004

(54) FLUORESCENT LAMP END-OF-LIFE PROTECTION CIRCUIT

(75) Inventors: Kevin J. Yang, Shanghai (CN); Haoran Zeng, Shanghai (CN)

(73) Assignee: Phi Hong Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 10/459,103

(22) Filed: Jun. 10, 2003

(65) Prior Publication Data

US 2004/0124787 A1 Jul. 1, 2004

(30) Foreign Application Priority Data

Dec. 25, 2002 (CN) ..... 02 1 57734 A

(51) Int. Cl.[7] ..... H05B 37/02
(52) U.S. Cl. ..... 315/119; 315/121; 315/225
(58) Field of Search ..... 315/119, 121, 315/123, 125, 74, 75, 225, 224

(56) References Cited

U.S. PATENT DOCUMENTS 4,970,438 A * 11/1990 Nilssen ..... 315/225
5,493,180 A * 2/1996 Bezdon et al. ..... 315/91
5,606,224 A * 2/1997 Hua ..... 315/121
6,177,768 B1 * 1/2001 Kamata et al. ..... 315/DIG. 4
6,661,182 B2 * 12/2003 Sridharan ..... 315/224

* cited by examiner

*Primary Examiner*—Don Wong
*Assistant Examiner*—Ephrem Alemu
(74) *Attorney, Agent, or Firm*—Darby & Darby

(57) ABSTRACT

A fluorescent lamp end-of-life protection circuit in an illuminating electric appliance, includes a rectifying effect protection circuit for a lamp tube and an overvoltage protection circuit for the lamp tube, in which a circuitry of two series resistors and a capacitor in series is connected in parallel with the lamp tube. A cathode of a transient voltage suppresser is connected to one end of the lamp tube, its anode is connected to an anode of a diode, and a cathode of the diode is connected to a common node of two series resistors. One end of a trigger diode is connected to a common node of the capacitor and the resistor, and the other end thereof is connected to a gate terminal G of a triac, a first electrode and a second electrode of of which are connected to two ends of the lamp tube respectively.

2 Claims, 2 Drawing Sheets

FLUORESCENT LAMP END-OF-LIFE PROTECTION CIRCUIT

BACKGROUND OF THE INVENTION

1. Fields of the Invention

The present invention relates to a fluorescent lamp end-of-life protection circuit in an illuminating electric appliance.

2. Related Technology

A fluorescent lamp is a Green light source, which is energy-saving and high-efficient, and the color-temperature of which are capable of being controlled, and it has been widely used in various fields and become a preferred choice of man-made light sources in daily life. It's lamp tube, however, may reach its end of life as the ageing of the fluorescent lamp.

There exist the following four cases in respect of end-of-life characteristics of the lamp tube and respective hazard; (1) The lamp tube leaks gas but the filament electrodes at both ends of the lamp tube are undamaged. In this case, the lamp tube cannot be started, but a preheating current is still supplied to the filaments by a ballast, and this may lead to a sharp increase of the temperature of a cathode. When the temperature is too high, the glass wall at the ends of the filament electrode may be melt or the connector at the holder of the lamp may be damaged, thus serious results such as fire may occur and at the same time, the ballast may out of work as excessive output power. (2) A cathode at one end of the lamp tube cannot emit electrons when the lamp tube is in use. In this case, because the temperature in one end of the lamp filament increases rapidly and extra power consumption is consumed, the ballast may out of work. Since the extra power consumption is centralized in the small area in the front of the cathode and is extremely unbalance, this may lead to overheating of the lamp holder, the glass wall, and the connector of the lamp. In the case, an asymmetric voltage appears across the lamp tube, which is referred to as "rectifying effect". (3) When the lamp tube is in use, both cathodes thereof cannot emit electrons, and the temperature of the lamp filaments at both ends of the lamp tube increases rapidly. In addition to the increase of the extra power consumption to menace the electronic ballast, the lamp tube voltage is also very high so as to result in the same result as that of the second case described above. (4) The lamp tube is lit, but the tube voltage rises rapidly, for example, due to dirt particles leaked into the lamp tube. If the ballast can sustain discharging, i.e., the ballast can supply normal current to the lamp tube, the power of the lamp tube will increase symmetrically as the rise of its voltage. Though not being localized, the extra power may still lead to overheating of both the lamp tube and the parts of the ballast.

In sum, the hazard mentioned in the case (1) can be avoided by a protection circuit of the ballast, and the cases (2), (3), and (4) can be classified into two types: rectifying effect and overvoltage of the lamp tube.

Only a certain case of the end-of-life characteristics of the lamp tube can be protected in the prior art, such as overvoltage protection of the lamp tube. As the first method, oscillating is stopped when the voltage arrives a set value, and this method is suitable for such a case in which a ballast is used for a lamp tube. As the second method, when the tube voltage arrives the set value, the tube which reaches its end of life is cut off, and this method is suitable for such a case in which a ballast is used for a plurality of lamp tubes. A signal for rectifying effect is acquired after rectifying the lamp tube voltage in bridge type. A thyristor is turned on when rectifying effect occurs in the lamp tube, therefore, the lamp tube in which rectifying effect occurs is shorten through a capacitor, and the lamp tube voltage is reduced in order to turn off the lamp tube. Since the signal is acquired by rectifying, this design works only for the symmetric overvoltage protection circuit, and does not work for asymmetric one. As another solution for protecting against rectifying effect of the lamp tube, by virtue of the asymmetry of positive and negative half-periods of the tube voltage, a direct current signal is extracted and supplied to an IC driving chip to stop an oscillator. In this technology, the voltage across both ends of the lamp tube is added after the positive and negative peaks are rectified. When the positive and negative peak voltage is asymmetric, a signal is sent to control the IC driving chip to stop oscillating and thereby implement protection. This solution will thus not work if the voltage is high and symmetric. Thus, it can be seen that the design of the lamp tube end-of-life protection circuit in the prior art are not all-sided, and the circuit is complicated. All of the circuits in the prior art cannot achieve protection substantially against the end of life of the fluorescent lamp.

SUMMARY OF THE INVENTION

A need exists for a simple and all-sided protection circuit which can shorten a fluorescent lamp in which rectifying effect and tube overvoltage occurs and has no influence on the other lamp tubes which are running normally. For abnormalities occurring at the end of life of the lamp tube, the present invention solves the problems in the prior art by detecting voltage waveform and amplitude of the lamp tube of the fluorescent lamp.

A fluorescent lamp end-of-life protection circuit in accordance with the present invention includes a lamp tube rectifying effect protection circuit and a lamp tube overvoltage protection circuit, characterized in that a circuitry of two series resistors and a capacitor in series is connected in parallel with the lamp tube, a cathode of a transient voltage suppresser is connected to one end of the lamp tube, its anode is connected to an anode of a diode, and a cathode the diode is connected to a common node of two series resistors; one end of a trigger diode is connected to a common node of the capacitor and the resistor, and the other end is connected to a gate terminal G of a triac; and a first electrode and a second electrode of the triac are connected to two ends of the lamp tube respectively.

The present invention can be sorted into a lamp tube rectifying effect protection circuit and a lamp tube overvoltage protection circuit according to its function. When rectifying effect occurs in the lamp tube, voltage across both ends of the lamp tube has asymmetric positive and negative half-wave waveforms in one period. The capacitor is charged by the tube voltage through two series resistors, therefore, a direct current component of the tube voltage is saved in the capacitor. The bi-directional trigger diode is turned on when the capacitor has saved a certain amount of energy. At the same time, the triac is turned on, and the lamp tube in which rectifying effect occurs can be protected thereby. When the lamp tube voltage increases rapidly and the positive and negative half-wave waveforms are still symmetric at the end of life of the lamp tube, the transient voltage suppresser is turned on. At this time, the tube voltage is applied to the resistor and the capacitor through the transient voltage suppresser and the diode. Therefore, there is enough energy in the capacitor to turn on the bi-directional trigger diode and the triac at the same time, and protection is obtained. In both cases as described above, when the bi-directional trigger diode is turned on, the triac is turned on. Because the first electrode and the second electrode of the triac are connected to two ends of the lamp tube respectively, the lamp tube is turned off when the triac is turned on, and a current flows to the triac so that neither current nor voltage is applied to the lamp tube which reaches its end of life. Accordingly, it is possible to prevent the cathodes at both ends of the lamp tube from overheating, and thus there does not exist hazard due to overheating of the lamp tube. With this technical solution, extra power consumption can be avoided and the electronic ballast can be protected.

DETAILED DESCRIPTION OF PREFERRED EMBODIMENTS

Figure 2:
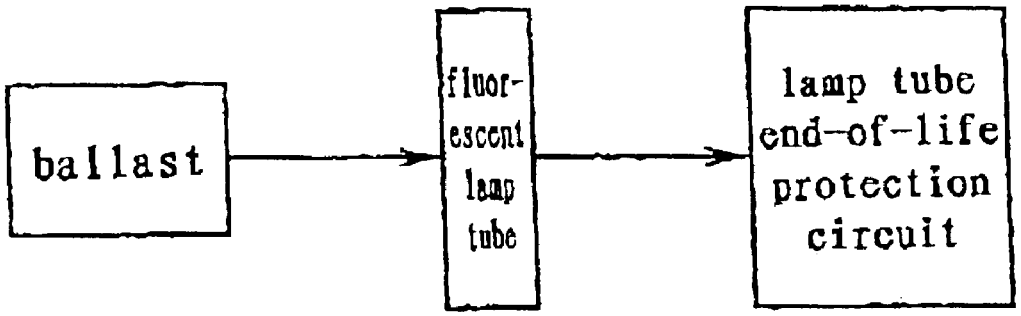
FIG. 2 shows a schematic diagram of an electronic ballast having protection function.

FIG. 2 shows an electronic ballast having a fluorescent lamp end-of-life protection, comprising a ballast, a fluorescent lamp and a lamp tube end-of-life protection circuit connected successively.

Figure 1:
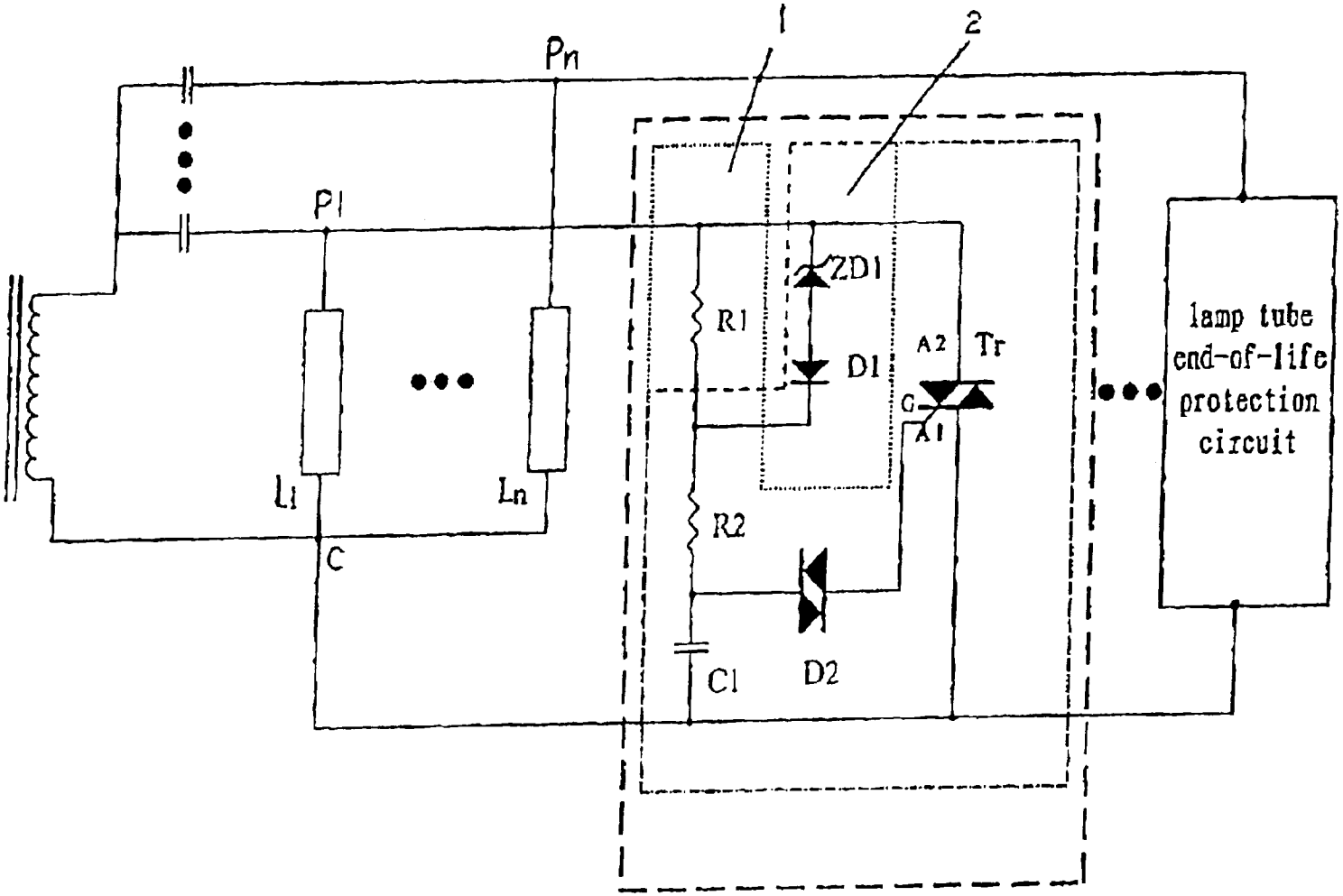
FIG. 1 shows a schematic diagram of a circuit structure in accordance with the invention.

FIG. 1 shows the best mode of an embodiment of the present invention, comprising a rectifying effect protection circuit 1 for a lamp tube and an overvoltage protection circuit 2 for a lamp tube. A common portion of both includes a resistor R2, a capacitor C1, a bi-directional trigger diode D2, and a triac Tr.

A specific embodiment of the invention is described thereafter. A circuitry of two series resistors R1, R2 and the capacitor C1 in series is connected in parallel with a lamp tube L1. A cathode of a transient voltage suppresser ZD1 is connected with one end P1 of the lamp tube, its anode is connected to an anode of the diode D1, and a cathode of the diode D1 is connected to a common node of the resistors R1, R2. One end of the trigger diode D2 is connected to a common node of the capacitor C1 and the resistor R2, and the other end is connected to the gate terminal G of the triac Tr. A first electrode A1 and a second electrode A2 of the triac are connected to two ends C, P1 of the lamp tube L1 respectively. For a lamp tube, it is possible to prevent the lamp tube, which reaches its end of life, from overheating by connecting in parallel with a set of "lamp tube end-of-life protection circuit" and the ballast can be protected thereby. When rectifying effect occurs in the lamp tube, voltage across both ends of the lamp tube has asymmetric positive and negative half-wave waveforms in one period, i.e., there is a direct current component in the voltage of the lamp tube. The direct current voltage is saved in the capacitor C1 through the resistors R1, R2. The bi-directional trigger diode D2 is turned on when the capacitor C1 has saved a certain amount of energy, and thus the triac Tr is turned on so as to implement protection function. When the lamp tube voltage increases rapidly and the positive and negative half-wave waveforms are still symmetric at the end of life of the lamp tube, the transient voltage suppresser ZD1 is turned on by the lamp tube voltage. At this time, the tube voltage is applied to the resistor R2 and the capacitor C1 through the transient voltage suppresser ZD1 and the diode D1. Therefore, the capacitor C1 may save enough energy to turn on the bi-directional trigger diode D2 and hence the triac Tr so as to obtain protection. When the protection function is obtained, the lamp tube which reaches its end of life is turned off and the current flows through the triac Tr. Therefore, with this fluorescent lamp end-of-life protection circuit, neither current nor voltage is applied to the lamp tube which reaches its end of life when the lamp tube reaches its end of life. Accordingly, it is possible to prevent the cathodes at both ends of the lamp tube from overheating, and to achieve the purpose of protection.

A plurality of sets of "the lamp tube end-of-life protection circuit" are needed when the ballast has a plurality of the lamp tubes Ln. The lamp tube end-of-life protection circuit is connected to both ends Pn, C of the respective lamp tube Ln. When the fluorescent lamp reaches its "end of life", the corresponding "lamp tube end-of-life protection circuit" begins to work such that the lamp tube which reaches its end of life is turned off, and has no influence on the other lamps which are running normally.

In accordance with the invention, except that the three kinds of abnormality protection at the end of life of the lamp tube are taken into consideration for security protection, the overvoltage protection circuit also integrates the capacitor C1 through the transient voltage suppresser ZD1, the diode D1, and the resistor R2 when one of the lamp tubes is removed. Because the tube voltage increases quickly when the lamp is turned off, the bi-directional trigger diode D2 and the triac Tr are turned on by energy in the capacitor C1 quickly, and voltage across both ends of the lamp tube thus decreases to zero volt quickly. Furthermore, since the resistor R1, R2, and the capacitor C1 are connected in series to form a circuitry and this circuitry is then connected to both ends of the lamp tube, integration time thereof is larger than starting time of the ballast and thus may not influence the startup of the ballast. In order to suit for tubes having different tube voltages, integration time and trigger voltage are selected by adjusting the resistor R1, R2, the capacitor C1, and the bi-directional trigger diode D2, and an trigger threshold of the tube overvoltage is selected by adjusting the transient voltage suppresser ZD1, while the trigger time of the lamp tube is determined by the resistor R2 and the capacitor C1.

What is claimed is:

1. A fluorescent lamp end-of-life protection circuit, comprising:

a lamp tube rectifying effect protection circuit for shorting both ends of a fluorescent lamp when rectifying effect occurs in its lamp tube; and a lamp tube overvoltage protection circuit for shorting both ends of the fluorescent lamp when overvoltage occurs in its lamp tube;

wherein said lamp tube rectifying effect protection circuit includes two series resistors, a capacitor, a trigger diode, and a triac; said lamp tube overvoltage protection circuit includes a transient voltage suppresser, a diode, one of two series resistors connected to said capacitor, said capacitor, said trigger diode, and said triac; and wherein, a circuitry of said two series resistors and said capacitor in series is connected in parallel with the lamp tube; a cathode of said transient voltage suppresser is connected to one end of the lamp tube, its anode is connected to a anode said diode, and a cathode of the diode is connected to a common node of said two series resistors; one end of said trigger diode is connected to a connection node between the capacitor and the resistors, and the other end thereof is connected to a gate terminal of said triac; other two electrodes of the triac are connected to two ends of the lamp tube respectively.

2. A fluorescent lamp end-of-life protection circuit according to claim 1 wherein said trigger diode is bi-directional trigger diode.

* * * * *